US009179721B2

(12) United States Patent
Hines et al.

(10) Patent No.: US 9,179,721 B2
(45) Date of Patent: Nov. 10, 2015

(54) PRESS AND GO WIG AND LACE WIG SNAP CAP AND KIT

(71) Applicants: Barbara Johnson Hines, Missouri City, TX (US); Tonnette Williams Hill, Shreveport, LA (US); Darryl Wayne Williams, Fresno, TX (US)

(72) Inventors: Barbara Johnson Hines, Missouri City, TX (US); Tonnette Williams Hill, Shreveport, LA (US); Darryl Wayne Williams, Fresno, TX (US)

( * ) Notice: Subject to any disclaimer, the term of this patent is extended or adjusted under 35 U.S.C. 154(b) by 57 days.

(21) Appl. No.: 14/068,227

(22) Filed: Oct. 31, 2013

(65) Prior Publication Data

US 2015/0114415 A1 Apr. 30, 2015

(51) Int. Cl.
*A41G 5/00* (2006.01)
*A41G 3/00* (2006.01)

(52) U.S. Cl.
CPC ..... *A41G 3/0008* (2013.01); *A41G 3/0033* (2013.01)

(58) Field of Classification Search
CPC ..... A41G 3/00; A41G 3/0016; A41G 3/005; A41G 3/0073; A41G 5/0041; A41G 5/0073
USPC ..... 132/201, 53–54
See application file for complete search history.

(56) References Cited

U.S. PATENT DOCUMENTS

| | | | | | |
|---|---|---|---|---|---|
| 3,295,536 | A | * | 1/1967 | Shaw et al. | 132/53 |
| 3,495,603 | A | * | 2/1970 | Young, Jr. | 132/53 |
| 3,605,761 | A | * | 9/1971 | Margo | 132/201 |
| 3,760,818 | A | * | 9/1973 | Schweifer | 132/53 |
| 3,809,099 | A | * | 5/1974 | Goldberg et al. | 132/53 |
| 3,889,414 | A | * | 6/1975 | Whetzel | 446/394 |
| 5,592,957 | A | * | 1/1997 | Gazerro et al. | 132/53 |
| 2008/0264435 | A1 | * | 10/2008 | Kugel | 132/56 |
| 2010/0065078 | A1 | * | 3/2010 | Reece | 132/54 |
| 2010/0326455 | A1 | * | 12/2010 | Karsenti et al. | 132/53 |

* cited by examiner

*Primary Examiner* — Todd Manahan
*Assistant Examiner* — Jennifer Gill

(57) ABSTRACT

The invention concerns a wig or lace wig cap, to be worn by the user underneath a wig or lace wig. The cap is comprised of a plurality of panels using stretchable and breathable material, an elasticized banding and a plurality of sew on snap fasteners affixed to, said banding to form the Press and Go Wig and Lace Wig Snap Cap. Cooperating snaps are then affixed to a wig or lace wig around the entire circumference of the outer inside wig weft, concealing the application process, thereby producing a comfortable, airy and secure fit to the user. An additional banding is included, affixed with a plurality of snap fasteners designed to fit cooperating snaps of a wig or lace wig. Also included is a tension strap affixed with two cooperating snap fasteners designed to be used as an adjustment strap to the cap banding or separate banding.

2 Claims, 3 Drawing Sheets

PRESS AND GO WIG AND LACE WIG SNAP CAP AND KIT

FIELD OF THE INVENTION

This invention relates to wigs, lace wigs and wig caps, in which a wig cap is worn underneath the wig to aid in the prevention of hair breakage and thinning hairlines, it's useful for aiding in the prevention of wig slippage and excessive movement.

BACKGROUND

Wigs have been worn for many years by women and men. They can generally be worn for prosthetic, cosmetic, or convenient reasons. They have been popular for many years as well. People, who have lost all or part of their hair due to illness, genetics or even alopecia, tend to benefit from the use of wearing wigs. Wigs come in various styles, colors, and lengths. For The most part, they are made of natural (human hair) or synthetic fibers (acrylic, modacrylic, nylon, or polyester). Human hair is a very popular choice because it looks and feels natural. It is easily styled and can be colored as well as permanently waved. Some manufacturers tend to blend synthetic and human hair, because when combined, the wig tends to retain the desired style and natural movement.

Ready-made wigs are available in stores and by mail order. They are usually a one size fit all model, that can adjust for fit individual heads by means of a stretchy foundation or adjustable tension springs or straps that are secured around the edges of the foundation. They can be custom made or made-to-order by using different sizes and shapes of stock foundations. They can be either machine made or hand-made.

Wearing a wig cap is beneficial in that it helps to hold in place the wig that is placed upon it. The material or fabric used to construct the cap is very vital to the comfort of the wearer when the cap is applied. It doesn't matter whether the hair is long or short, a wig cap can be used. It prevents the wig from slipping, while protecting the wearer natural hair. When using a lace wig, the cap gives the appearance of a natural part when the hair is parted. The hair can be parted throughout the entire head to create a natural looking part. Wig caps can be made of different colors as well as with different fabric types. Some caps are thicker than others and can cause the wearer head to be exposed to extreme heat. Some are thin, providing airy wear, reducing the amount of moisture in heated conditions. Suitability depends upon the wearer, no two people are alike.

SUMMARY OF INVENTION

The invention came into existence through years of being a beauty salon owner and operator seeking for better quality products and supplies. I think that we all are born with a distinct talent to create. I found it necessary to seek areas in the field that would provide adequate replacement to a much needed solution. How can I improve the construction of a wig cap and make it a useful function that will provide my clients with the comfort of knowing their wigs and lace wigs are secure? No one wants their secrets revealed or made obvious to observers. I feel that this invention can help solve that problem. A wig kit comprising a wig cap or elastic band and a wig attachable to the cap or elastic band with a series of snap fasteners is provided to solve the above mentioned problems.

DETAILED DESCRIPTION

Figure 1:
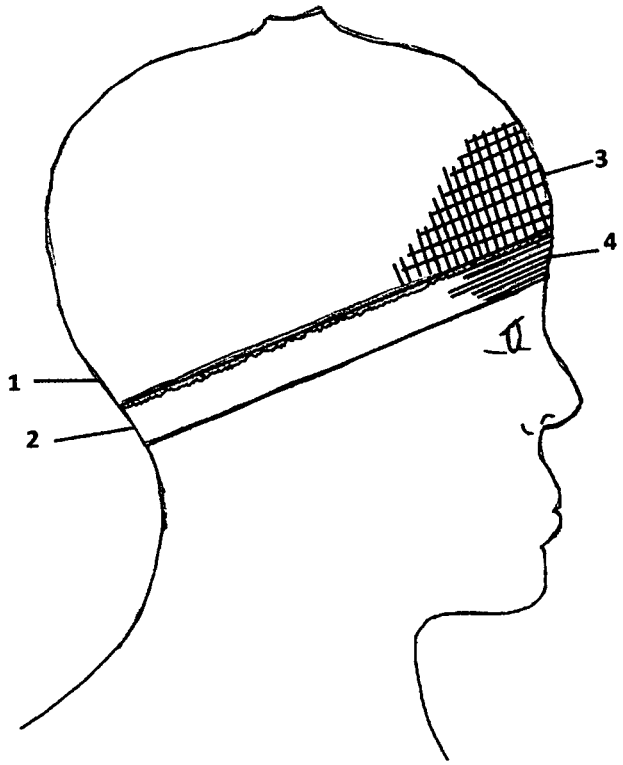
FIG. 1 is a perspective view of the right side of a head with a wig cap applied to the head.

FIG. 1 is a perspective view taken from the wearer's right side of a wig and lace wig cap 1, constructed and sewn together to form a comfortable fit. It is constructed with nylon, knit, polyester, etc. fabrics to create the shape of the wearer's head. It is adjustable based upon the measurements of the fabric. Sizes of small, medium, large and extra large can be constructed by increasing or decreasing the measurements. It can be constructed in various colors such as beige, neutral, black, brown or natural skin tone colors, so as to match the skin and scalp tones of each wearer. 2 is an elastic band that is also measured to fit sizes small, medium, large and extra large head frames. It is made of durable premium elastic banding. It is connected to 1 at the base of 1 with a stretch stitch in order to form a completed wig and lace wig cap. 3 is the view of the grid pattern of the upper portion of the wig cap that allows air to move through the wig and lace wig cap when worn by the wearer. The design pattern of the grid may change due to the design of the fabric pattern. 4 is a grid pattern of the wig and lace wig cap band. It has straight stretch ridges because of the elastic fiber content. The pattern of the grid may also change based upon the pattern of the fabric design. 1, 2, 3, and 4 make up the essential components for a comfortable and breathable wig and lace wig cap.

Figure 2A:
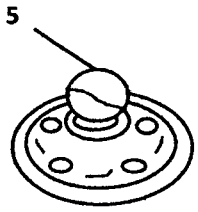
FIG. 2 is a perspective view of a sew-on snap fastener with ball and socket fittings.
Figure 2B:
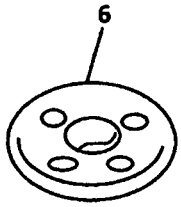

FIG. 2 is the perspective view of a sew-on snap fastener, with a ball 5 and socket 6 portion that connect together to form the snap closure. The snap can be of metal, nickel, or plastic material. The sew-on snap fastener ball portion 5 is used in accordance with the wig and lace wig cap band 2 of FIG. 1. Its application requires using the sewing method or it can also be applied using hypo-allergenic glue. The method in which the snap is applied, there should be no contact of the snaps with the wearer's head because they are sewn onto the outer band. The socket portion 6 will be applied to 7, the outer edge of inside wig or lace wig of FIG. 4.

Figure 3:
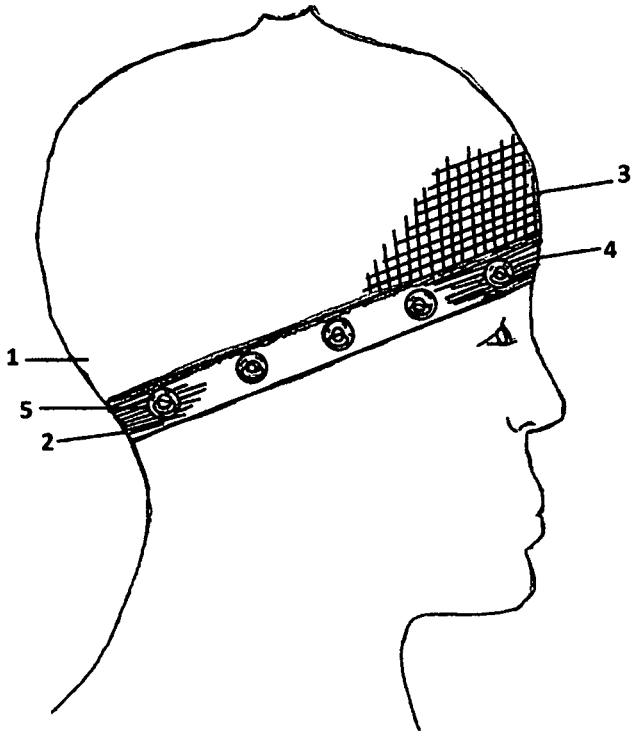
FIG. 3 is a perspective view of the right side of a head with a wig cap applied and the ball portion of the sew-on snap fastener of FIG. 2.

FIG. 3 is a perspective view of the right side of the wearer's head. The wig and lace wig cap 1 of FIG. 1 and all its components 2, 3, 4, are shown along with the sew-on-snap fastener portion 5 of FIG. 2 which has been attached by sewing to the wig and lace wig cap band 2 of FIG. 1. The sew-on snap fastener portion 5 is sewn with exact measured distance between snaps, covering the entire circumference of the elastic band 2.

Figure 4:
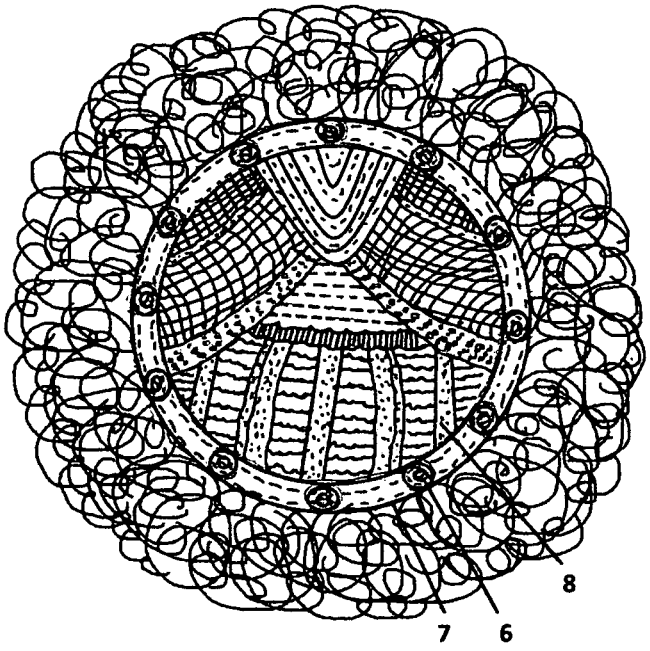
FIG. 4 is a perspective view of the inside of a wig, showing the wefts, and inner foundation with the socket portion of the sew-on snap fastener of FIG. 2 sewn onto the entire outer edge of the wig.

FIG. 4 is perspective view of a wig or lace wig. The sew-on snap fastener 6 is also sewn to the outer edge of the inner side of the wig or lace wig 7. The distance must be the exact same distance apart as to meet the measurements of the ball portion 5 of the sew-on snap fastener. The distance is determined by the width of the wig or lace wig outer edge foundations. Placement must be exact or the sew-on snap ball portion 5 will not properly align itself with socket portion 6, 8 is the perspective view of the entire inside of the wig or lace wig with the hair wefts showing.

Figure 5:
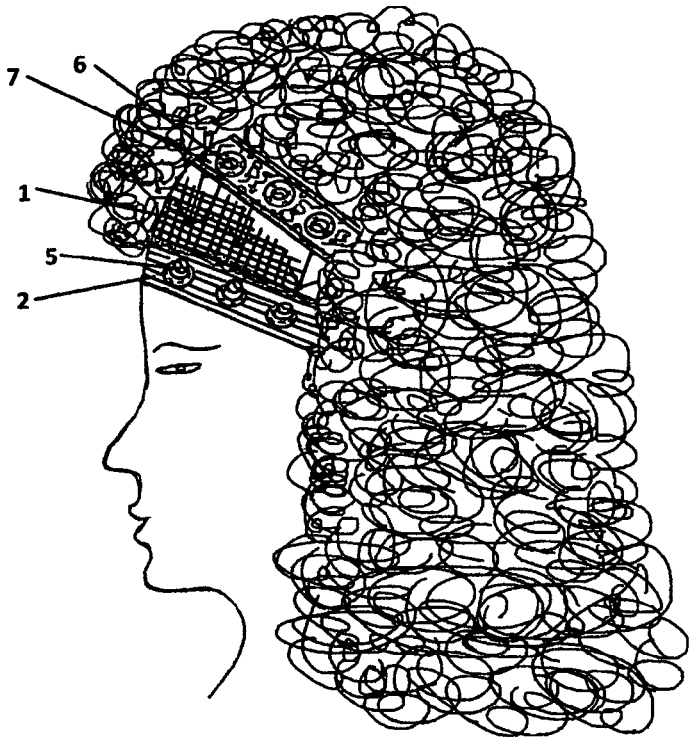
FIG. 5 is a perspective view of the left side of a person head with the wig cap FIG. 1, the sew-on snap fastener ball portion of FIG. 2, combined to create FIG. 3, which is situated on a person head, along with the wig of FIG. 4 with the sew-on snap fastener socket portion of FIG. 2 shown on the outer edge of the wig foundation.

FIG. 5 is the perspective view of the left side of a person's head with the wig or lace wig cap of FIG. 1 partially shown with its components 1, 2, and 5 of FIG. 2., and the outer inner edge of the wig or lace wig foundation 7 flipped upward in order to show the placement of the socket portion 6 of the sew-on snap fastener FIG. 2 and FIG. 4. When the sew-on snap fasteners 5 and 6 are connected, it will then conceal the application, causing the wearer to experience a comfortable and structured fit unnoticeable to observers.

Figure 6A:
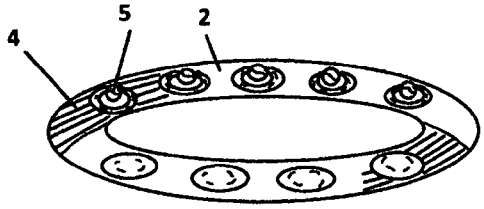
FIG. 6 is a perspective view of an elastic band with the ball portion of the sew-on snap fasteners of FIG. 2 attached around the entire circumference of the elastic band which make up part of the kit. The lower picture is a perspective view of a tension strap with the socket portion of the sew-on snap fastener of FIG. 2.
Figure 6B:
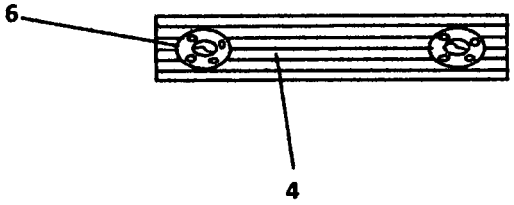

FIG. 6 is the perspective view of an additional elastic banding 2 of FIG. 1 without the wig or lace wig cap 1 of FIG. 1, designed to be included with FIG. 3 as part of a kit. This band 2 will allow wearer's to use it almost in the same manner as the entire wig or lace wig cap construction, only without the upper portion 1. The ridges 4 are shown in the same manner as FIG. 1 and FIG. 3. It is also constructed with a sew-on snap ball fastener 5 as of FIG. 2. A wearer can have the same comfortable and secure fit but with the opportunity to have a more airy feel. It is equally durable as it is also made of durable premium elastic banding.

A tension strap is also included in the kit. It is assembled by using a portion of elastic banding 2 cut about 2 to 3 inches in diameter, along with the socket portion 6 of FIG. 2. It is used to tighten the fit of the banding 2 of FIG. 3 when needed.

REFERENCE NUMERALS

1 upper portion of wig or lace wig cap
2 band-lower portion of wig or lace wig cap
3 grid lines of upper portion of wig or lace wig cap
4 ridge lines of band-lower portion of wig or lace wig cap
5 ball portion (sew-on snap fastener)
6 socket portion (sew-on snap fastener)
7 wig (inner outer edge) area of sew-on snap placement
8 wig (inside view of wefts design)

REFERENCES CITED

| | | | |
|---|---|---|---|
| 1,490,479 | April 1924 | Noel | 132/53 |
| 3,889,414 | June 1975 | Whetzel | 132/53 |
| 3,968,521 | July 1976 | Bashlow | 132/53 |
| 4,016,888 | April 1977 | Smiley | 132/53 |

We claim:

1. A wig kit comprising:

a lace wig being formed from a plurality of panels stitched together thereby forming stretch seams between said panels, wherein together said stitched panels form a complete circular wig capable of surrounding at least a crown of a wearer's head in use, said wig having a front and a rear and a lower peripheral edge, with the lower peripheral edge having an elasticized banding attached thereto, such that said elasticized banding of the lower peripheral edge forms an entire lower circumference of said wig and said elasticized banding further comprising a plurality of snap fastener socket portions affixed to and spaced around an entire interior perimeter of the wig and wherein an exterior of the wig panels comprise hair attached thereto;

a lace wig snap cap, intended to be worn on a wearer's head underneath the wig, said cap being formed from a plurality of panels stitched together thereby forming stretch seams between said panels, wherein together said stitched panels form a complete circular cap capable of encircling at least a crown of a wearer's head in use, said cap having a front and a rear and a lower peripheral edge, with the lower peripheral edge having an elasticized banding attached thereto, such that said elasticized banding of the lower peripheral edge forms an entire lower circumference of said cap and said elasticized banding further comprises a plurality of snap fastener ball portions affixed to and around an entire exterior perimeter of the elasticized banding and said ball and socket portions interact during use;

a separate annular elastic band comprising an open top end and an open bottom end such that in use a top of a wearer's head is fully exposed through the open top end of the annular elastic band and further comprising a second plurality of snap fastener ball portions affixed to and around an entire exterior circumference of the elastic band and wherein in use the ball portions of the elastic band interact with the socket portions of the wig; and an elastic tension strap comprising two cooperating snap fastener socket portions affixed on each end of the tension strap in order to allow a user to tighten the fit of said elasticized banding of said cap or to tighten the fit of said separate annular elastic band during use by attaching both of said socket portions of said tensions strap to two of said ball portions of either of said elasticized banding of said cap or said separate annular elastic band and wherein the tension strap is an independent separate strap.

2. The kit of claim 1, wherein said cap, said wig, or said tension strap is comprised of nylon, knit, polyester, or a stretchable fabric.

* * * * *